US009456660B1

(12) United States Patent
Magdaleno et al.

(10) Patent No.: US 9,456,660 B1
(45) Date of Patent: Oct. 4, 2016

(54) ODOR IMPREGNATED SHOE INSERT ASSEMBLY

(76) Inventors: Armando Magdaleno, Camarillo, CA (US); Elizabeth Magdaleno, Camarillo, CA (US)

( * ) Notice: Subject to any disclaimer, the term of this patent is extended or adjusted under 35 U.S.C. 154(b) by 2037 days.

(21) Appl. No.: 12/553,715

(22) Filed: Sep. 3, 2009

(51) Int. Cl.
*A43B 13/38* (2006.01)
*A43B 17/08* (2006.01)
*A43B 1/00* (2006.01)

(52) U.S. Cl.
CPC ..... *A43B 17/08* (2013.01); *A43B 1/0045* (2013.01)

(58) Field of Classification Search
CPC ..... A43B 17/00; A43B 17/08; A43B 17/10; A43B 17/102; A43B 1/0045
USPC ..... 36/43, 44, 71
See application file for complete search history.

(56) References Cited

U.S. PATENT DOCUMENTS

| | | | | |
|---|---|---|---|---|
| 4,192,086 | A * | 3/1980 | Sichak | 36/44 |
| 4,257,176 | A * | 3/1981 | Hartung et al. | 36/44 |
| 4,517,308 | A * | 5/1985 | Ehlenz et al. | 502/401 |
| D302,624 | S | 8/1989 | Thompson et al. | |
| 4,864,740 | A | 9/1989 | Oakley | |
| 5,261,169 | A * | 11/1993 | Williford | 36/43 |
| 5,438,768 | A | 8/1995 | Bauerfeind | |
| 5,732,485 | A | 3/1998 | Laughlin et al. | |
| 5,829,167 | A | 11/1998 | Valenzuela | |
| 6,227,458 | B1 | 5/2001 | Dever et al. | |
| 6,922,918 | B2 | 8/2005 | Issler | |
| 7,047,671 | B2 | 5/2006 | Steed et al. | |
| 7,765,717 | B2 * | 8/2010 | Van Dyck | 36/3 B |
| 2008/0115385 | A1 * | 5/2008 | McLinden | 36/44 |

* cited by examiner

*Primary Examiner* — Jila M Mohandesi

(57) ABSTRACT

An odor impregnated shoe insert assembly includes a panel that has a size and shape to conform to and cover an insole of a shoe. The panel has an upper surface, a lower surface and a perimeter edge. A covering is mounted on completely covers the upper surface of the panel. The covering is impregnated with a scent. The panel is positioned within the shoe and the shoe placed on a foot to transfer the scent to the foot.

5 Claims, 3 Drawing Sheets

ODOR IMPREGNATED SHOE INSERT ASSEMBLY

BACKGROUND OF THE DISCLOSURE

Field of the Disclosure

The disclosure relates to shoe insert devices and more particularly pertains to a new shoe insert device for transferring a pleasant scent to a foot for the purpose of masking foot odor.

SUMMARY OF THE DISCLOSURE

An embodiment of the disclosure meets the needs presented above by generally comprising a panel that has a size and shape to conform to and cover an insole of a shoe. The panel has an upper surface, a lower surface and a perimeter edge. A covering is mounted on completely covers the upper surface of the panel. The covering is impregnated with a scent. The panel is positioned within the shoe and the shoe placed on a foot to transfer the scent to the foot.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
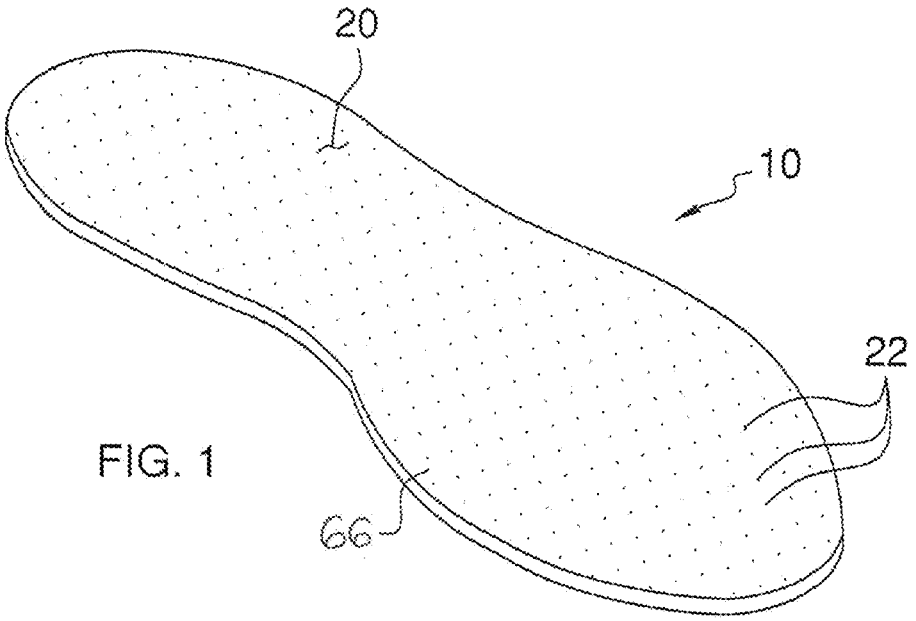
FIG. 1 is a top perspective view of a odor impregnated shoe insert assembly according to an embodiment of the disclosure.
Figure 2:
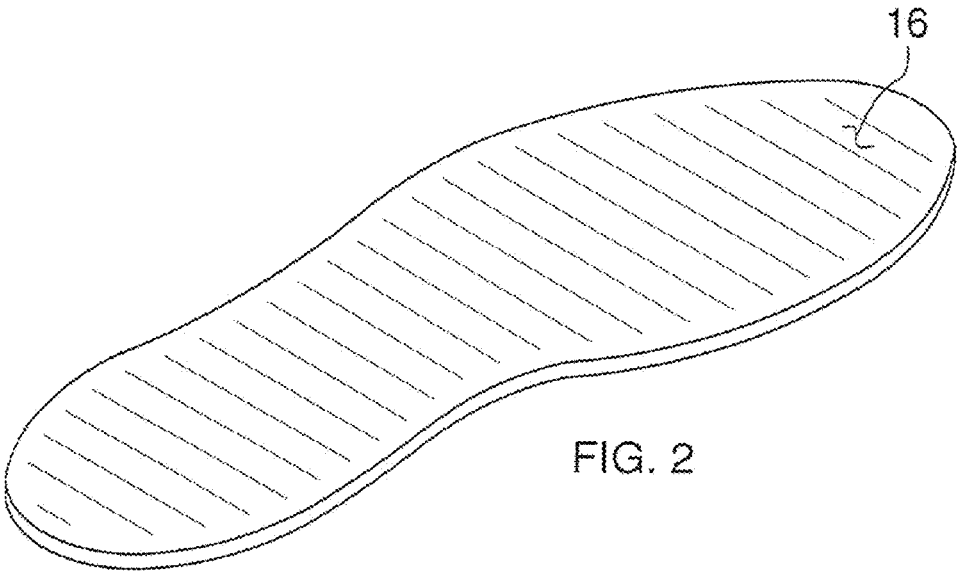
FIG. 2 is a bottom perspective view of an embodiment of the disclosure.
Figure 3:
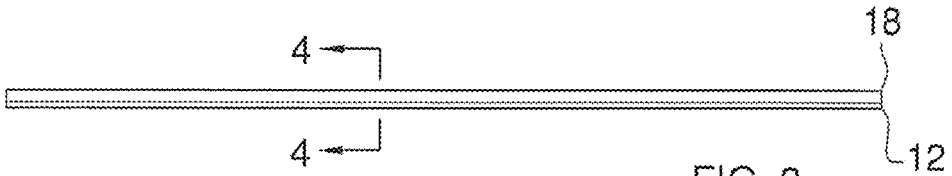
FIG. 3 is a side view of an embodiment of the disclosure.
Figure 4:
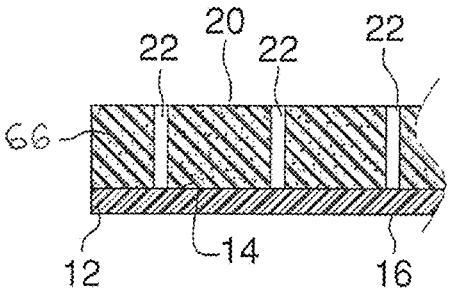
FIG. 4 is a cross-sectional view taken along line 4-4 of FIG. 4 of an embodiment of the disclosure.
Figure 5:
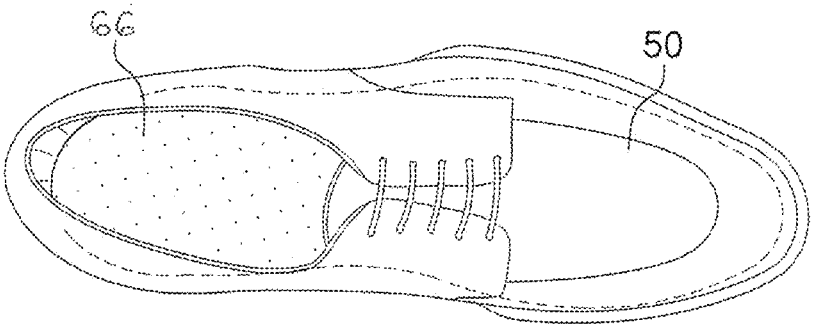
FIG. 5 is a top in-use view of an embodiment of the disclosure.

With reference now to the drawings, and in particular to FIGS. 1 through 7 thereof, a new shoe insert device embodying the principles and concepts of an embodiment of the disclosure and generally designated by the reference numeral 10 will be described.

As best illustrated in FIGS. 1 through 7, the odor impregnated shoe insert assembly 10 generally comprises a panel 12 that has a size and shape to conform to and cover an insole of a conventional shoe 50. The panel 12 has an upper surface 14, a lower surface 16 and a perimeter edge 18. The panel 12 is comprised of a flexible material which may include an elastomeric material. Generally, the panel 12 may be comprised of a non-foamed material having no apertures therein though foamed elastomers or plastics may be utilized.

A covering 66 is mounted on completely covers the upper surface 14 of the panel 12. The covering 66 is impregnated with a scent. While the scent may include any scent determined to be pleasing to humans, in particular the scent may be selected from botanical essential oils derived from plants such as vanilla, citrus oils (such as lemon, orange and lime), strawberry, apple and cherry, though other scents and oils more akin to those used in colognes, perfumes and such may be utilized. Moreover, sweet smells such as chocolate and the like may be utilized as well. The covering 66 is comprised of a resiliently compressible material. The resiliently compressible material may be a foamed elastomeric material to allow for air to be drawn into and expelled from the covering 66 as it is compressed and released during usage of the shoe 50. The covering 66 has a top side 20 having a plurality of apertures 22 therein extending downwardly to the panel 12 to further increase airflow and better spread the scent.

Figure 6:
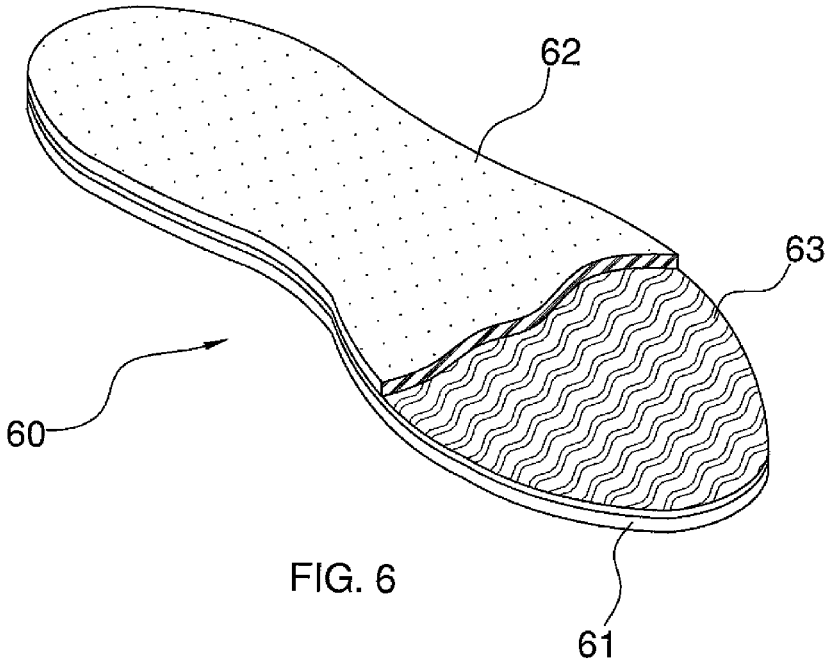
FIG. 6 is a broken top perspective view of an embodiment of the disclosure.
Figure 7:
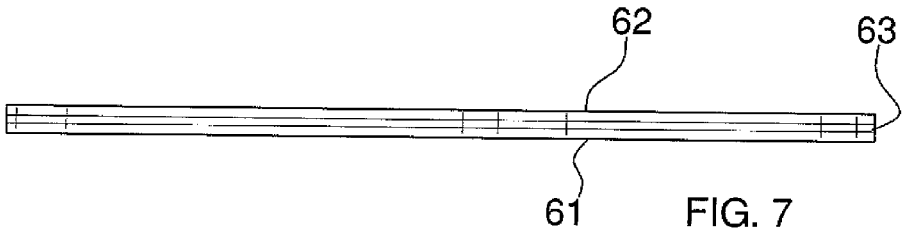
FIG. 7 is a side view of an embodiment of the disclosure.

FIGS. 6 and 7 depict another embodiment of the assembly 60 which includes a panel 61 and covering 62 as discussed above, but which also includes a middle layer 63 positioned between the panel 61 and the covering 62. The middle layer 63 may comprise a gel which itself is scented and which releases the scent through the covering. The scent used may include those listed above. The gel, or middle layer 63, allows for a larger volume of scent to be used which will be dispensed over a longer period of time.

In use, the panel 12 is positioned within the shoe 50 and the shoe 50 placed on a foot to transfer the scent to the foot. This will mask foot odors and provide a pleasant scent to the foot.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A shoe insert assembly being removably positionable within a shoe to mask foot odor, said assembly including:

a panel having a size and shape to conform to and cover an insole of the shoe, said panel having an upper surface, a lower surface and a perimeter edge;

a covering being mounted on completely covering said upper surface of said panel;

a middle layer being positioned between said panel and said covering, said middle layer comprising a scented gel; and wherein said panel is positioned within the shoe and the shoe placed on a foot to transfer the scent to the foot;

wherein said covering is comprised of a resiliently compressible material;

wherein said resiliently compressible material is a foamed elastomeric material; and wherein said covering has a top side having a plurality of apertures therein extending downwardly from a top surface of said covering to said panel.

2. The assembly according to claim 1, wherein said panel is comprised of a non-foamed material.

3. The assembly according to claim 1, wherein said scent is selected from the group consisting of botanical essential oils.

4. The assembly according to claim 1, wherein said scent includes a botanical essential oil.

5. The assembly according to claim 1, wherein said covering has a top side having a plurality of apertures therein extending downwardly to said middle layer.

* * * * *